United States Patent [19]

Wride et al.

[11] Patent Number: 5,076,897

[45] Date of Patent: Dec. 31, 1991

[54] GAS TURBINE BLADES

[75] Inventors: Vernon M. Wride; Alan Taylor; John Foster, all of Weston-super-Mare, England

[73] Assignee: BAJ Limited, Avon, England

[21] Appl. No.: 659,017

[22] Filed: Feb. 21, 1991

[30] Foreign Application Priority Data

Feb. 23, 1990 [GB] United Kingdom ..... 9004132

[51] Int. Cl.[5] ..... C25D 5/10; C25D 15/00

[52] U.S. Cl. ..... 205/110; 205/143; 205/176

[58] Field of Search ..... 204/40, 44.5, 48, 49

[56] References Cited

U.S. PATENT DOCUMENTS 3,830,711 8/1974 Kedward ..... 204/48

4,789,441 12/1988 Foster ..... 204/48

*Primary Examiner*—T. M. Tufariello

*Attorney, Agent, or Firm*—Wallenstein, Wagner & Hattis, Ltd.

[57] ABSTRACT

A method of producing a gas turbine blade having an abrasive tip comprising producing a binding coat on the tip of the blade body by electrodeposition, the binding coat comprising MCrAlY where M is one or more of iron, nickel and cobalt, anchoring to the binding coat coarse particles of an abrasive material by composite electrodeposition of the particles and an anchoring coat from a bath of plating solution having the abrasive particles suspended therein, and then plating an infill around the abrasive particles. The anchoring coat may be of cobalt or nickel or MCrAlY as above defined and preferably has a thickness less than 30 μm. The infill material may also be MCrAlY as above defined. Preferably, deposition of the infill is accompanied by vibration of the blade in a direction which is substantially vertical and substantially along the axis of the blade.

26 Claims, 4 Drawing Sheets

FIG.1.
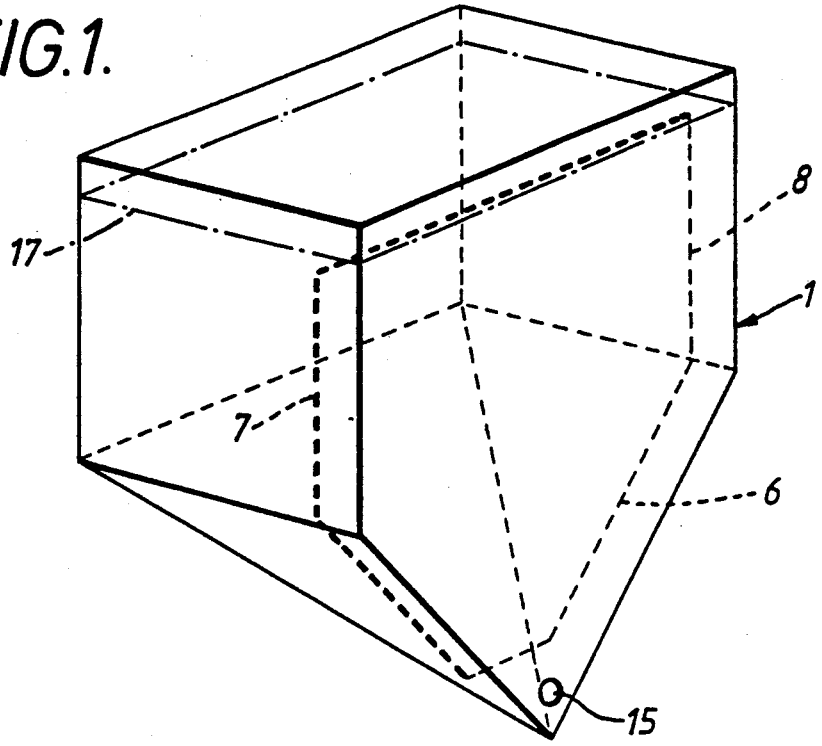
FIG.2.
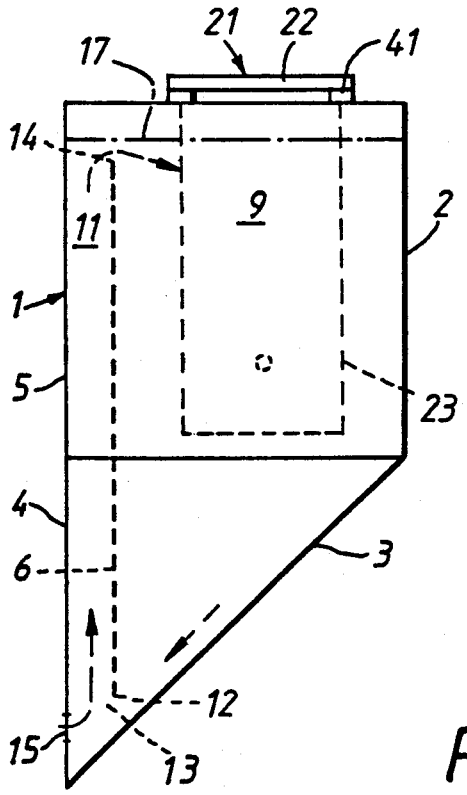
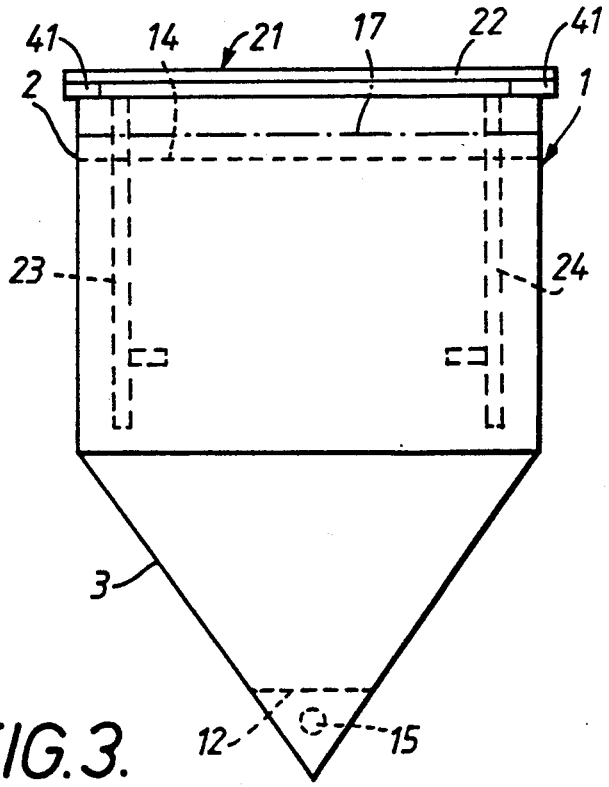
FIG.3.

GAS TURBINE BLADES

This invention relates to gas turbine blades and in particular relates to the production of blade tip seals.

It is known to provide at the tip of a gas turbine blade a tip portion comprising abrasive particles which are embedded in a matrix, the tip being intended to run against the surface of a shroud of a material which is softer than the abrasive particles. By this means, it is possible to produce, by the abrasive action of the particles on the shroud, a gap between the tip and the shroud which is very small, thus minimising gas losses. In one particular example where this technique is used, the matrix comprises a major part of cobalt and minor parts of chromium, tantalum and alumina while the lining material of the shroud comprises a major part of cobalt with minor parts of nickel, chromium and aluminium and a small quantity of yttrium. The method by which such tips are produced is extremely expensive. In one example, detonation spray coating of the matrix is used. In another example there is first produced an inner tip portion of mainly nickel and cobalt with additional ingredients by casting as a single crystal and the inner tip portion is, after shaping, diffusion bonded to the tip of the blade body. The abrasive portion of the tip is then formed on the inner tip portion by electrodeposition of alternating layers of chromium and nickel about the abrasive particles. The outer tip portion can then be aluminided to produce a matrix alloy of NiCrAl.

It is an object of the invention to provide an abrasive tip on a gas turbine blade by a method which is cheaper and simpler than the known methods as described.

According to the present invention, a method of producing a gas turbine blade having an abrasive tip comprises producing a binding coat on the tip of the blade body by electrodeposition, the binding coat comprising MCrAlY where M is one or more of iron, nickel and cobalt, anchoring to the binding coat coarse particles of an abrasive material by composite electrodeposition from a bath of plating solution having the abrasive particles suspended therein, and then plating an infill around the abrasive particles.

It has been found that this method, all stages of which are of a metal plating nature and are therefore relatively inexpensive and readily controllable, produces a very effective abrasive blade tip. There is produced a tip which comprises a) a binding layer of MCrAlY which gives extremely good protection against oxidation and corrosion and provides a base on which the particle containing layer can be anchored, b) a layer of an anchoring material, preferably cobalt or MCrAlY with a preferred thickness of less than 30 μm, perhaps 20 μm or less and even as low as 2–10 μm, which holds the abrasive particles (which .will have an average particle diameter substantially greater than the thickness of the anchoring layer) to the binding layer, and c) a further layer preferably of MCrAlY, which infills around the particles and holds them firmly while allowing them to protrude, if necessary, to enable them to maximise their abrasive function. Deposition of the complete tip will, in most cases, be followed by a heat treatment step to homogenise the layers to produce what, in effect, will approach a single homogenous layer (of MCrAlY if the three layers are all MCrAlY) with particles in, and possibly protruding from, the uppermost portion thereof.

Various particles may be employed. Examples include zirconia, alumina and various nitrides, silicides and borides known from the abrasive art. The preferred abrasive is cubic boron nitride, preferably having a particle size between 125 and 150 μm. It is possible for the infill, or at least the upper or outer portion thereof, to include abrasive particles of a size substantially smaller than the main abrasive particles, for example approximately 20 μm.

The MCrAlY of the binding coat, the anchoring layer where this is MCrAlY, and the infill where this is MCrAlY may have various compositions of which suitable examples are described in British Patent Specification GB-2167446B. The electrodeposition may be effected by various forms of apparatus. However, suitable forms of apparatus are described in British Patent Specification Nos. GB-2182055A and European Patent Specification No. EP-0355051A. These describe apparatus which comprises an electroplating tank which is divided into two zones by a vertical wall extending from close to the bottom of the tank up to just beneath the surface of the solution in the bath. Gas is admitted to one of the zones to induce an upward flow of solution therein, the solution, with particles entrained therein, spilling over the weir formed by the upper edge of the dividing wall and descending in the second zone in which the article to be coated is located. The latter specification describes rotating the article with a stop-start or quick-slow cycle.

Where the infill is of MCrAlY, that is it consists of particles of CrAlY in a metal matrix, the deposition of the infill is preferably accompanied by vibration of the blade, preferably in a direction axial of the blade or containing a substantial component in this direction. It is believed that such vibration ensures an even distribution of CrAlY particles, particularly in those regions which are shaded by the overhang of the abrasive particles and which regions might otherwise be depleted of particles. The frequency of the vibration is preferably between 10 Hz and 1 kHz, the particularly preferred figure being about 50 Hz. A peak acceleration of up to 10 g is preferred. It has been found that a particularly good result is achieved by vibrating at two alternating levels, for example a vibration with a peak level of about 2 g alternating with a vibration with a peak level of about 10 g. Preferably, each lower level phase is longer than each higher level phase; thus the lower level phases may be for between 30 seconds and 2 minutes duration with a peak acceleration of about 2 g and the higher level phases may be for about 5 seconds duration with a peak acceleration of about 10 g.

The invention may be carried into practice in various ways but a process of producing a gas turbine blade in accordance with the invention together with apparatus suitable for carrying out the process will now be described by way of example with reference to the accompanying drawings in which:

FIG. 1 is a perspective view of one of the plating baths used in the process;

FIG. 2 is a side elevation of the apparatus shown in FIG. 1;

FIG. 3 is a front elevation of the apparatus shown in FIG. 1;

Figure 4:
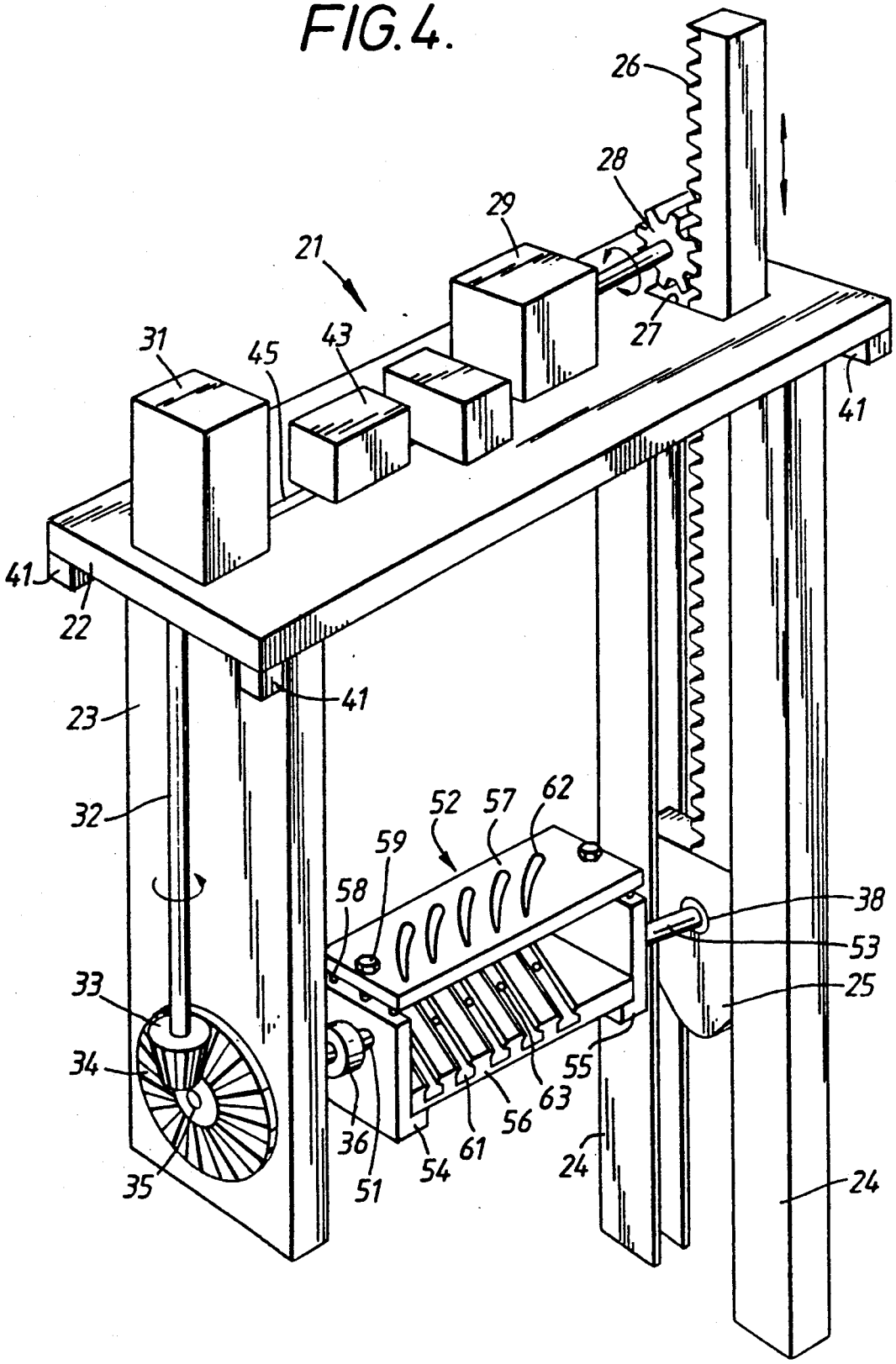
FIG. 4 is a perspective view of the fixture used in the apparatus shown in FIGS. 1 to 3.

The apparatus shown in FIG. 1 to 3 of the drawings comprises a vessel or container 1 having a parallelepiped shaped upper portion 2 and a downwardly tapering lower portion 3 in the form of an inverted pyramid which is skewed so that one side face 4 forms a continuation of one side face 5 of the upper portion.

The vessel 1 contains a partition 6 which lies in a vertical plane parallel to the side faces 4 and 5 of the vessel and makes contact at its side edges 7 and 8 with the adjacent vertical and sloping faces of the vessel. The partition thus divides the vessel into a larger working zone 9 and a smaller return zone 11. At its bottom, the partition 6 terminates at a horizontal edge 12 above the bottom of the vessel to afford an interconnection 13 between the working zone 9 and the return zone 11. At its top, the partition 6 terminates at a horizontal edge 14 below the top edges of the vessel 1.

At the bottom of the return zone 11 there is an air inlet 15 which is connected to an air pump (not shown). Mounted in the working zone 9 is a fixture 21 to which the workpieces to be coated are mounted, the fixture 21 being arranged to move the workpieces within the vessel in a manner to be described in greater detail below. Conductors, not shown, are provided to apply a voltage to the workpiece mounted on the fixture 21 relative to an anode which is suspended in the working zone.

To use the apparatus to codeposit a coating on the workpieces, the workpieces are mounted on the fixture 21 which is positioned in the vessel as shown. Before or after the positioning of the fixture, the vessel is filled to a level 17 above the top edge 14 of the partition 6 with a plating solution containing particles to be co-deposited. Air is admitted to the inlet 15 and this rises up the return zone 11, raising solution and entrained particles. At the top of the return zone, the air escapes and the solution and particles flow over the broad crested weir formed by the top edge 14 of the partition and flow down past the workpieces on the fixture 21. At the bottom of the working zone 9, the particles tend to settle and slide down the inclined sides of the vessel towards the interconnection 13 where they are again entrained in the solution and carried round again.

As the downwardly travelling particles in the working zone 9 encounter the workpiece, they tend to settle on the, workpiece where they become embedded in the metal which is being simultaneously plated out.

Figure 5:
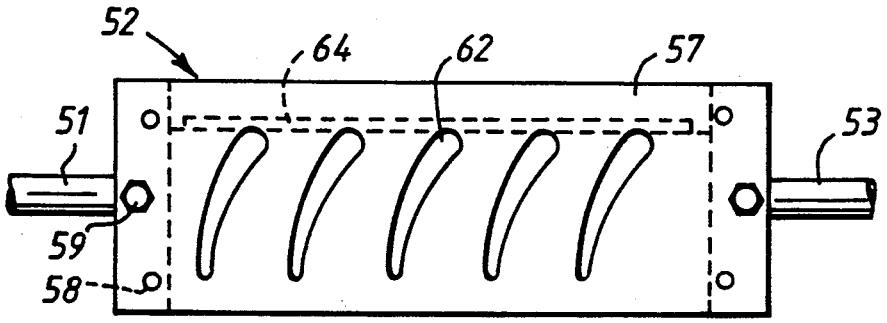
FIG. 5 is a plan view of a jig used in conjunction with the fixture shown in FIG. 4.
Figure 6:
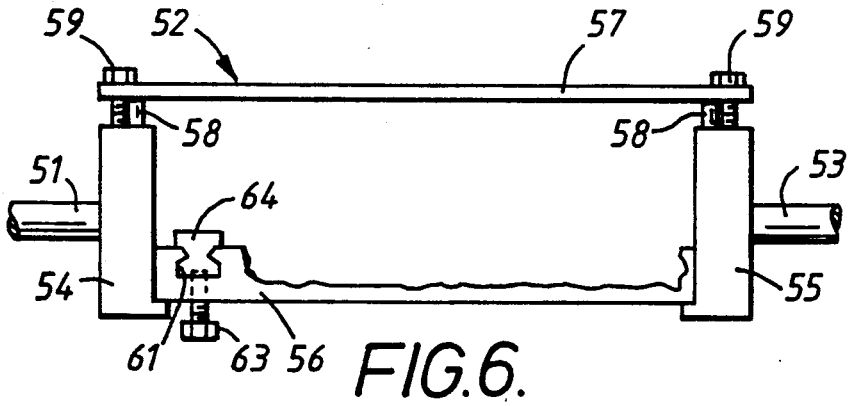
FIG. 6 is a front view of the jig shown in FIG. 5.

The fixture 21 on which the workpieces to be coated are mounted is shown in detail in FIG. 4, in simplified form in FIGS. 2 and 3 and is omitted from FIG. 1 for reasons of clarity. The fixture 21 comprises a deck 22 which fits over the top of the vessel 1, a depending pillar 23 towards one end and a pair of depending guides 24 at the other end. The guides 24 have facing guideways in which slides a cross-head 25 carrying a vertical rack 26 which passes upwards through a hole 27 in the deck 22 and meshes with a pinion 28 driven by a reversible electric motor 29. The deck 22 supports a second electric motor 31 which drives a vertical shaft 32 carrying a bevel pinion 33 which engages a crown-wheel 34 fixed to one end of a spindle 35 mounted in the pillar 23. The other end of the spindle 35 is connected by a universal joint 36 to a trunnion 51 on one end of a jig 52 which is only shown diagrammatically in FIG. 4 but is shown in greater detail in FIGS. 5 and 6. At the other end of the jig 52 is a second trunnion 53 which enters a spherical bearing 38 in the cross head 25.

At each end of the underside of the deck 22 there are springs 41 by which the jig is supported on the edges of the vessel 1 as seen in FIGS. 2 and 3. Mounted on the deck 22 is a vibrator 42 whose operation can be adjusted as required by a controller, not shown. An electronic motor controller 43 is mounted on the deck 22 and is connected by lines 45 to the motors 29 and 31. The controller 43 is designed so that, when required, the motor 31 is driven in one direction only (but with the possibility of a stop-start or two level action) so as to rotate the spindle 35 about a nominally horizontal axis (the x-axis). The controller 43 is designed to drive, when required, the motor 29 alternately in opposite directions to reciprocate the cross-head 24 and so superimpose on the rotation about the x-axis an oscillatory rotation about a rotating axis in the universal joint 36 (the y-axis).

The jig 52 comprises a generally box-like unit having open sides and comprising a first end 54 connected to the trunnion 51, a second end 55 connected to the trunnion 53, a base 56 rigidly connected and joining the ends 54 and 55 and a removable lid 57. Each of the ends 54,55 carries fixed studs 58 which butt against the underside of the lid 57 and bolts 59 which pass freely through apertures in the lid 57 and engage in threaded bores in the upper edges of the ends 54 and 55 to enable the lid 57 to be screwed down onto the stud 58. The base 56 is formed with grooves 61 to receive the roots of turbine blades to be tipped and the lid 57 is formed with aerofoil shaped apertures 62 to receive the outer ends of the blades. The blades are retained in position in the groove 61 by screws 63. A plate 64 at the rear end of the grooves 61 limits their movement out of the groove 61.

The use of apparatus of the construction described to produce an abrasive tip on a gas turbine blade will now be described.

The blade is degreased in vapour degreaser or a proprietary degreasing agent such as Genklene. With the top plate of the jig 52 removed, the root of the blade is then introduced into one of the grooves 61 in the bottom plate 56 until it engages the back plate 64 and it is then clamped in position by tightening of the screw 63 against the underside of the root. The top plate is then replaced and held down by tightening of the screws 59. In this condition the tip of the blade is approximately level with the top surface of the plate 57 with a gap of approximately 1 mm extending all the way around the periphery of the blade between it and the adjacent edge of the aperture 62. The blade and the holder are then grit blasted as necessary to provide a key for the masking wax and the holder is then inserted into a wax bath to mask all the surfaces of the holder and blade. The upper surface of the plate 57 and the tip of the blade are then grit blasted with 50–100 micrometers alumina. The jig with the blade therein is then given an anodic clean for five minutes at 6 to 8 volts in a cleaning solution consisting of sodium hydroxide/gluconate/thiocyanate and is then rinsed thoroughly in cold running water. The exposed surfaces of the blade and the plate 57 are then etched in a solution comprising approximately 300 gms/l ferric chloride, 58 gms/l hydrochloric acid and 1% hydrofluoric acid (60% w/w) for five minutes at room temperature and again rinsed thoroughly in cold running water. The jig is then placed in a nickel chloride bath to provide a strike which is given at 3.87 amps per square decimeter (36 amps per square foot) for four minutes. The strike bath comprises approximately 350 gms/l nickel chloride and 33 gms/l hydrochloric acid.

The jig 52 is then placed in the fixture shown in FIG. 4 and the fixture is placed in the apparatus shown in FIGS. 1 to 3. Alternatively, the jig and fixture may be assembled before the pre-treatment procedures. The bath contains a cobalt plating solution with 2 to 5 weight percent particles of CrAlY containing 67–68 parts by weight Cr, 29–31 parts by weight Al and 1.5–2.4 parts by weight Y with a size distribution in the bath as given in the following table, the columns relating to the size band being the upper and lower limits of the cut measured in micrometers. The size distribution in the as-deposited coating will be similar but somewhat smaller due to selection in the plating process.

Table

| Size Band | | Percent |
|---|---|---|
| 118.4 | 54.9 | 0 |
| 54.9 | 33.7 | 0 |
| 33.7 | 23.7 | 0.3 |
| 23.7 | 17.7 | 1.3 |
| 17.7 | 13.6 | 4.3 |
| 13.6 | 10.5 | 17.7 |
| 10.5 | 8.2 | 38.1 |
| 8.2 | 6.4 | 18.3 |
| 6.4 | 5.0 | 12.3 |
| 5.0 | 3.9 | 8.2 |
| 3.9 | 3.0 | 0.1 |
| 3.0 | 2.4 | 0 |
| 2.4 | 1.9 | |

Plating is continued for a period of 4 hours at a current density of 1.075 amps per decimeter (10 amps per square foot) with the controller 43 set to rotate the motor 31 at such a speed as to rotate the holder 52 at 0.33 revolutions per minute. The motor 29 is stationary during this operation but air is admitted continuously to maintain circulation of the solution and suspended CrAlY particles. This plating provides a coat of CoCrAlY on the tip of the blade to a thickness of between 25 and 50 μm. Alternatively, the production of the binding coat may be performed using the fixture shown in FIG. 8 and employing vibration as will be described in greater detail below. Deposition of CoCrAlY from the bath described will produce a layer having a composition which is approximately in weight percent: Al 10, Cr 23, Y 0.5 and the balance Co.

The holder is then rinsed over the tank with demineralised water and then removed from the region of the tank and rinsed in running water. The holder is then placed in a Woods nickel bath or 1 volume percent sulphuric acid bath to reactivate the surface and the fixture is then placed in a second bath similar to the first bath except that in place of the CrAlY particles it contains particles of cubic boron nitride of 100/200 mesh i.e. approximately 125–150 μm. With the jig in the attitude shown in FIG. 4, i.e. with the blade tip horizontal and facing upwardly, and with the motors 29 and 31 inactive and no air being admitted through the inlet 15, plating is commenced at 2.7 amps per decimeter (25 amps per square foot) and air is switched on for a period of 5 seconds. The boron nitride particles go into circulation and cascade over the blade and holder. Plating is then continued without the admission of air for a period of approximately 40 minutes to secure the particles resting on the blade tip to the tip. It may be found that in some cases it is beneficial to have a further burst of 5 seconds of air after 20 minutes to ensure a uniform and maximum distribution of CBN particles over the blade tip surface. The motor 31 is now activated to turn the holder 52 slowly through 180° to allow excess and unanchored particles of CBN to fall off.

The fixture 21 is now removed from the CBN bath, is rinsed over the tank and is then rinsed in a static bath and finally rinsed thoroughly in running water. The surfaces being coated are then reactivated in a Woods nickel or 1% sulphuric acid bath and the fixture is replaced in the CoCrAlY bath. The motor 31 is activated to rotate the jig at 0.33 rpm and plating, is continued for 7 hours at 1.075 amps per decimeter/(10 amps per square foot) for 7 hours (with continuous admission of air to maintain circulation of the solution and suspended CrAlY particles) to fill the spaces under and around the CBN particles with CoCrAlY to a depth which, as can be seen in FIG. 7, leaves the tips of the abrasive particles slightly proud of the surrounding CoCrAlY.

During the infilling process to provide a matrix around the particles, the holder may be rotated with the start/stop action described in European patent application number 89307713. Thus the motor 31 is controlled to produce a rotation of the jig 52 unidirectionally and at a speed of one rotation in 3 minutes with the rotation being intermittent with 10 second stop periods being interspersed with three second go periods. Alternatively however the vibrator 42 may be used with the motor 31 inactive, the jig 52 being held in the position shown in FIG. 4 with the tip surfaces of the blades horizontal and upwards. The vibrator 42 is arranged to give a vibration at a frequency of 50 Hz with alternating periods of high intensity and low intensity vibration, the high intensity periods having a duration of 5 seconds and a peak acceleration of 10 g and the low intensity periods having a duration of 75 seconds with a peak acceleration of 2 g. Alternatively, a combination of rotation and vibration may be used, either simultaneous or alternating. Where rotation is employed it is probable that any vibration that may be considered desirable need be only at the low intensity level referred to above. The vibration and the rotation produce homogeneous infill and ensure that the CrAlY particles reach the areas shadowed by the CBN particles.

At the end of the infill stage the fixture is removed and the holder is rinsed over the tank with demineralised water and then rinsed thoroughly in running water. The masking material is then removed and the blade is taken out of the jig and degreased. After inspection the blade is then heat treated for between ½ and 1 hour at 1090 plus or minus 10° C. in vacuum or in 50–100 millibar partial pressure argon and fast gas quenched. The blade is then aluminized by one of the well-known processes such as pack aluminizing.

Figure 7:
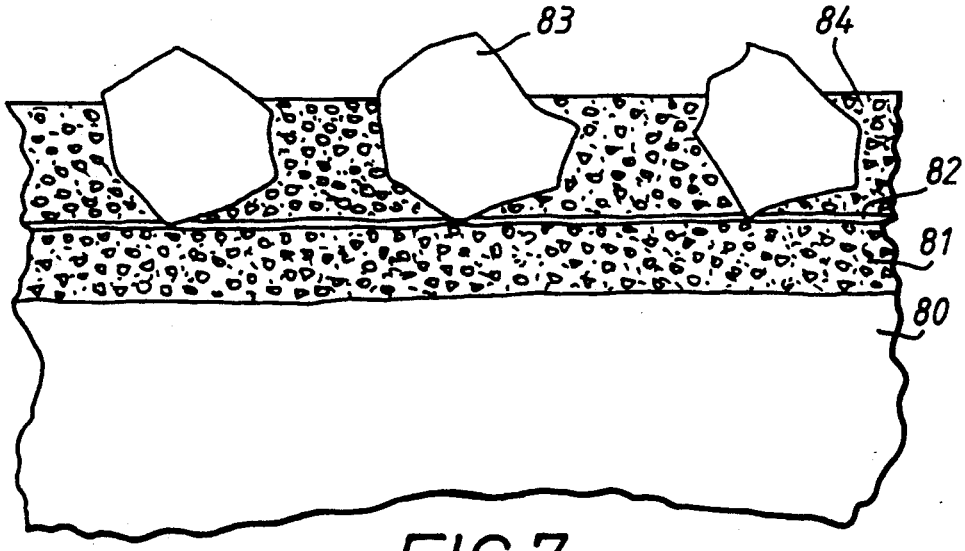
FIG. 7 is an enlarged section through part of the tip region of a blade having an abrasive tip produced in the manner to be described.

The tip produced in the manner described is shown in section in FIG. 7 and can be seen to comprise the body 80 of the blade, a binding coat 81 of MCrAlY of a thickness, in this example, of 25–50 μm, an anchoring coat 82 of MCrAlY of a thickness of 10–20 μm in which is anchored the bottom portions of the abrasive particles 83 of cubic boron nitride with a particle size of 125–150 μm, and an infill 84 of MCrAlY with a thickness of 70–110 μm.

Figure 8:
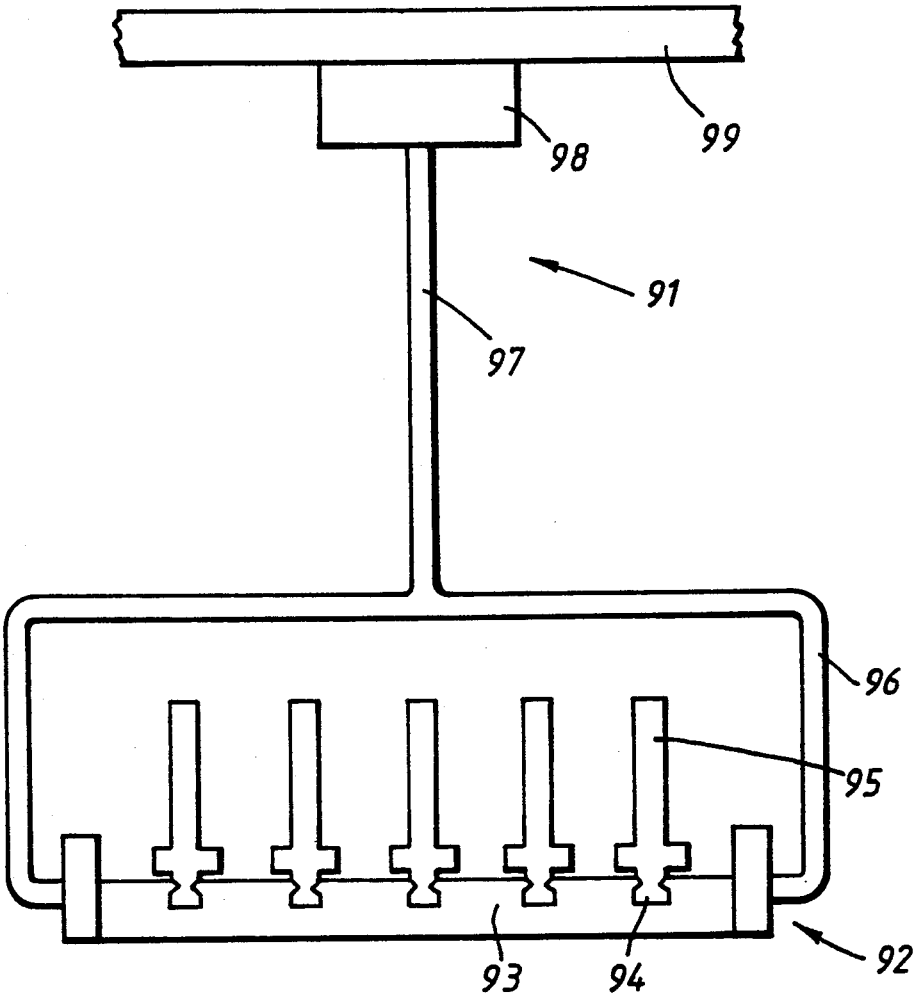
FIG. 8 shows an alternative apparatus for applying the infill.

A simplified form of fixture 91 suitable for producing either or both the binding layer and the infill is shown in FIG. 8 and this may be used in place of the fixture shown in FIG. 4. The fixture 91 comprises a jig 92 having a base 93 similar to the base 56 of the jig 52 and having grooves 94 to receive the roots of the blades 95, the blades being locked in position by means not shown, such as screws similar to the screws 63 of the jig 52. The base 93 is carried by a bail 96 at the bottom of a rod 97 depending from a vibrator 98 carried on a beam 99 from which the fixture can be suspended in the working zone 9 of the vessel 1 shown in FIGS. 1 to 3.

In the use of the apparatus shown in FIG. 8 in which there is no provision for rotation of the fixture, the two level vibration described in relation to FIG. 4 is used, i.e. longer periods of duration 75 seconds at a lower intensity with a peak acceleration of 2 g alternating with shorter periods of 5 seconds with a peak acceleration of 10 g.

Instead of particles of pure cubic boron nitride it would be possible to use particles of this or another abrasive which are coated with a material which will protect them, for a time at least, from severe oxidation. For example, it would be possible to use cubic boron nitride particles which had been given a substantially air-impermeable coating of aluminium oxide or an intermetallic such as nickel aluminide.

I claim:

1. A method of producing a gas turbine blade having an abrasive tip comprising producing a binding coat on the tip of the blade body by electrodeposition, the binding coat comprising MCrAlY where M is one or more of iron, nickel and cobalt, anchoring to the binding coat coarse particles of an abrasive material by composite electrodeposition from a bath of plating solution having the abrasive particles suspended therein, and then plating an infill around the abrasive particles.

2. A method as claimed in claim 1 in which the anchoring material is cobalt or nickel.

3. A method as claimed in claim 1 in which the anchoring material is MCrAlY where M is Ni or Co or Fe or two or all of these metals.

4. A method as claimed in claim 3 in which the thickness of the anchoring material is less than 30 μm.

5. A method as claimed in claim 4 in which the thickness of the anchoring material is approximately 2–10 μm.

6. A method as claimed in claim 1 in which the infill material consists of or includes MCrAlY where M is Ni or Co or Fe or two or all of these metals.

7. A method as claimed in claim 3 in which the infill material consists of or includes MCrAlY where M is Ni or Co or Fe or two or all of these metals.

8. A method as claimed in claim 1 in which at least the part of the infill remote from the anchoring material includes abrasive particles of smaller size than the abrasive particles anchored by the anchoring material.

9. A method as claimed in claim 1 in which deposition of the infill material is followed by a heat treatment step to homogenise the material of the layers other than the abrasive particles.

10. A method as claimed in claim 9 in which the heat treatment is followed by an aluminizing step.

11. A method as claimed in claim 1 in which the abrasive particles are of zirconia, alumina, a nitride, a silicide, a boronide or mixtures of these materials.

12. A method as claimed in claim in which the abrasive particles are cubic boron nitride.

13. A method as claimed in claim 12 in which the size of the abrasive particles anchored by the anchoring material is between 125 and 150 μm.

14. A method as claimed in claim 13 in which the thickness of the infill is between 70 and 100 μm.

15. A method as claimed in claim 1 in which the deposition of the infill is accompanied by vibration of the blade.

16. A method as claimed in claim 15 in which the vibration is in a direction axial of the blade or containing a substantial component in this direction.

17. A method as claimed in claim 16 in which during vibration the axis of the blade is substantially vertical.

18. A method as claimed in claim 17 in which the frequency of vibration is between 10 Hz and 1 kHz.

19. A method as claimed in claim 18 in which the frequency of vibration is approximately 50 Hz.

20. A method as claimed in claim 16 in which vibration occurs at two alternating levels.

21. A method as claimed in claim 20 in which at one level the peak acceleration is approximately 2 g and at the other level is approximately 10 g.

22. A method as claimed in claim 21 in which the duration of the lower level phase is several times the duration of the higher level phase.

23. A method as claimed in claim 22 in which the lower level phase is for between 30 seconds and two minutes duration and the higher level phase is approximately five seconds duration.

24. A method of producing a gas turbine blade having an abrasive tip comprising the steps of:

providing a blade body having a tip;

producing on said tip a binding coat by electrodeposition, said binding coat comprising MCrAlY where M is selected from the group comprising iron, nickel and cobalt;

anchoring to the binding coat coarse particles selected from the group comprising zirconia, alumina, a nitride, a silicide, and a boronide, said particles having a size between 125 and 150 μm, by composite electrodeposition from a bath of cobalt or nickel plating solution, the deposited thickness of the deposited cobalt or nickel being less than 30 μm, and plating around said anchored abrasive particles an infill comprising MCrAlY where M is selected from the group comprising iron, nickel and cobalt.

25. The method of claim 24 in which at least the part of the infill remote from the anchoring material includes abrasive particles of smaller size than the abrasive particles anchored by the anchoring material.

26. The method of claim 24 in which the deposition of the infill is accompanied by vibration of said blade body in a direction which is substantially vertical and substantially along the longitudinal axis of said blade body.

* * * * *

UNITED STATES PATENT AND TRADEMARK OFFICE

CERTIFICATE OF CORRECTION

PATENT NO. : 5,076,897

DATED : December 31, 1991

INVENTOR(S) : Vernon M. Wride et al.

It is certified that error appears in the above-identified patent and that said Letters Patent is hereby corrected as shown below:

Column 1, line 56, after "which" delete ".".

Column 3, line 50, after "on the" delete ",".

Column 6, line 10, after "plating" delete ",".

Column 6, line 11, after "decimeter" delete "/".

Column 6, line 21, delete "89307713" and insert --89307713.1--.

Column 8, Claim 12, line 4, after "claim" insert --1--.

Signed and Sealed this

Twenty-seventh Day of April, 1993

*Attest:*

MICHAEL K. KIRK

*Attesting Officer*

*Acting Commissioner of Patents and Trademarks*